US009507302B2

(12) United States Patent
Taguchi

(10) Patent No.: US 9,507,302 B2
(45) Date of Patent: Nov. 29, 2016

(54) IMAGE FORMING APPARATUS

(71) Applicant: CANON KABUSHIKI KAISHA, Tokyo (JP)

(72) Inventor: Sho Taguchi, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/047,534

(22) Filed: Feb. 18, 2016

(65) Prior Publication Data

US 2016/0246229 A1 Aug. 25, 2016

(30) Foreign Application Priority Data

Feb. 20, 2015 (JP) ..... 2015-032065

(51) Int. Cl.
*G03G 15/20* (2006.01)

(52) U.S. Cl.
CPC ..... *G03G 15/2053* (2013.01)

(58) Field of Classification Search
USPC ..... 399/107, 110, 122, 320, 328, 329; 219/216, 619
See application file for complete search history.

(56) References Cited

U.S. PATENT DOCUMENTS 6,583,389 B2 * 6/2003 Murooka ..... H05B 3/0095 118/60
2006/0153605 A1 * 7/2006 Nishiyama ..... G03G 15/2042 399/329
2014/0314438 A1 * 10/2014 Maeda ..... G03G 21/1685 399/92
2014/0314458 A1 * 10/2014 Mitani ..... G03G 15/2017 399/329
2015/0037078 A1 * 2/2015 Ohta ..... G03G 15/2053 399/329

FOREIGN PATENT DOCUMENTS

JP H08305190 A 11/1996
JP H1184919 A 3/1999
JP 2012-123329 A 6/2012
JP 2014-238560 A 12/2014

* cited by examiner

*Primary Examiner* — Hoan Tran
(74) *Attorney, Agent, or Firm* — Canon U.S.A. Inc., IP Division

(57) ABSTRACT

A fixing apparatus includes a film, a heater contacting an inner surface of the film, a heat conducting member contacting a back surface of the heater, and a supporter supporting the heater, the supporter including a groove accommodating the heater and the heat conducting member. A surface of the groove facing an end surface of the heater on a downstream side includes a first protrusion, a second protrusion, and a third protrusion with gaps between each other in a direction orthogonal to the conveyance direction, the third protrusion being disposed between the first protrusion and the second protrusion and having a smaller protruding amount than the first protrusion and the second protrusion. a portion of the heat conducting member facing the third protrusion is recessed more than portions of the heat conducting member facing the first protrusion and the second protrusion.

7 Claims, 9 Drawing Sheets

IMAGE FORMING APPARATUS

BACKGROUND OF THE INVENTION

1. Field of the Invention

The present invention relates to a fixing apparatus in an image forming apparatus such as a printer or a copier which employs electrophotography.

2. Description of the Related Art

Some known fixing apparatuses provided in an image forming apparatus such as a copier or a laser beam printer, is an apparatus use a film. Generally, such a fixing apparatus includes the film in a tubular shape, a heater of a plate shape which is in contact with an inner surface of the film, and a pressing member that forms a nip portion together with the heater across the film. The fixing apparatus executes fixing processing in which a recording medium with a toner image formed thereon is heated while being conveyed through the nip portion, so that the toner image is fixed on the recording medium. The fixing apparatus uses a film with a low heat capacity and thus can be warmed up in a short period of time, so that a first print out time (FPOT) of the image forming apparatus can be shortened.

It has been widely known that when the film with a low heat capacity is used, temperature in a sheet non-passing portion rises, that is, an excessive temperature rise in a portion where a recording medium does not pass through is likely to occur in the fixing apparatus. In view of the above, Japanese Patent Application Laid-Open No. 11-84919 discusses a configuration for preventing the temperature rise in the sheet non-passing portion. More specifically, the temperature rise in the sheet non-passing portion is prevented by bringing a heat conducting member such as an aluminum alloy into contact with a surface of the heater disposed opposite to a surface of the heater contacting the film, to increase thermal conductivity in a longitudinal direction.

A fixing apparatus of the type described above includes a heater holder having a trench portion in which the heater is accommodated. The trench portion has a larger width than the heater in consideration of a component tolerance. Thus, while the film is rotating, the heater moves to contact a surface of the trench portion on a downstream side in a conveyance direction of a recording medium. As a result, a gap is formed between a surface of the trench portion on an upstream side and an end surface of the heater. When this gap is wide, foreign substance such as a staple attached to the recording medium, might enter the gap and form a hole in the film (Japanese Patent Application Laid-Open No. 2012-123329). In view of the above, in some apparatuses, two protrusions serving as positioning portions for a heater in a direction orthogonal to the conveyance direction of the recording medium, and a protrusion that is disposed between the two protrusions and prevents warpage of the heater are provided on the surface of the trench portion facing the end surface of the heater on the downstream side in the conveyance direction of the recording medium. Such protrusion of a small width can be accurately manufactured and its gap can be made smaller easily. Furthermore, the protrusion for preventing the warpage of the heater prevents the warpage of the heater, and thus prevents the gap from widening. Thus, in such a known fixing apparatus, the gap can be kept small in a stable manner, so that the foreign substances can be prevented from entering the gap.

However, the fixing apparatus in which the heat conducting member and the heater are accommodated in the trench portion of the heater holder has the following problem. When frictional force produced by the rotation of the film is applied to the heat conducting member through the heater, the heat conducting member warps in the conveyance direction of the recording medium and is brought into contact with the protrusion for preventing the warpage of the heater. When the heat conducting member in this state thermally expands, the heat conducting member may deform to lift from the heater. When this happens, the effect in preventing the temperature rise of the sheet non-passing portion is reduced. In other words, the fixing apparatus including the holding member in which the heat conducting member and the heater are accommodated in the trench portion has a problem in that it is difficult to achieve both prevention of entrance of foreign substances into the gap between the trench portion and the heater and the maintain the effect in preventing the temperature rise of the sheet non-passing portion.

SUMMARY OF THE INVENTION

According to one aspect of the present invention, a fixing apparatus in which a recording medium on which a toner image has been formed is heated while being conveyed through a nip portion to fix the toner image on the recording medium includes a film in a tubular shape, a heater of a plate shape and is in contact with an inner surface of the film, a heat conducting member that is in contact with a surface of the heater disposed opposite to a surface contacting the film, and a holding portion configured to hold the heater via the heat conducting member, the holding portion including a trench portion configured to accommodate the heater. A surface of the trench portion facing an end surface of the heater on a downstream side in a conveyance direction of the recording medium includes a first protrusion and a second protrusion that are disposed being spaced apart from each other in a direction orthogonal to the conveyance direction of the recording medium, as well as a third protrusion that is disposed between the first protrusion and the second protrusion and has a smaller protruding amount in a direction opposite to the conveyance direction than protruding amounts of the first protrusion and the second protrusion. In an end surface of the heat conducting member on the downstream side in the conveyance direction of the recording medium, a portion facing the third protrusion is offset in a direction apart from the third protrusion compared with portions facing the first protrusion and the second protrusion.

Further features of the present invention will become apparent from the following description of exemplary embodiments with reference to the attached drawings.

DESCRIPTION OF THE EMBODIMENTS

A first exemplary embodiment of the present invention is described below with reference to the drawings. In the present exemplary embodiment, a longitudinal direction is parallel with a direction orthogonal to a conveyance direction of a recording medium, and a transverse direction is parallel with the conveyance direction of the recording medium.

<Image Forming Apparatus>

Figure 1A:
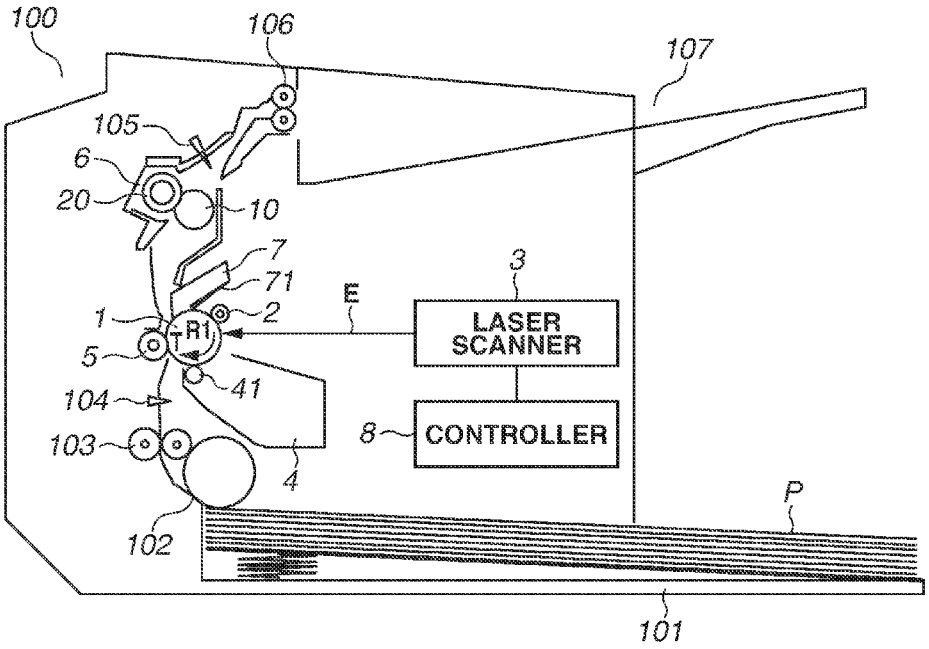
FIG. 1A is a cross-sectional view of an image forming apparatus according to a first exemplary embodiment.
Figure 1B:
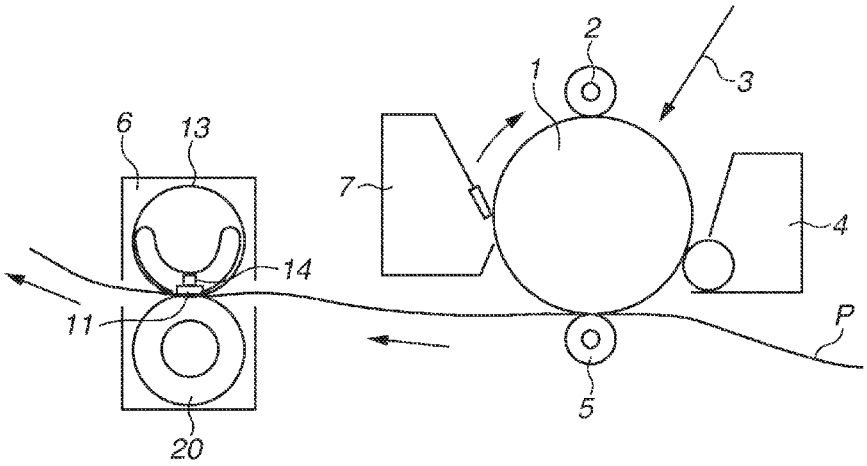
FIG. 1B is an enlarged view illustrating an image forming unit and a fixing unit according to the first exemplary embodiment.

FIG. 1A is a schematic cross-sectional view of a printer as an image forming apparatus according to the present exemplary embodiment. FIG. 1B is an enlarged view of an image forming unit and a fixing unit. The printer includes a photosensitive drum 1. The photosensitive drum 1 is rotated driven by a driving unit (not illustrated) in a direction indicated by an arrow R1 at a predetermined process speed (circumferential speed). A surface of the photosensitive drum 1 is uniformly charged by a charging roller 2 to have a predetermined polarity and potential. An electrostatic latent image is formed on the charged photosensitive drum 1 with a laser beam E from a laser scanner 3. The laser scanner 3 performs scanning exposure, controlled to turn ON and OFF in accordance with image information. Thus, charges in an exposed portion are removed, so that the electrostatic latent image is formed on the surface of the photosensitive drum 1. The electrostatic latent image is developed by a developing device 4 and visualized. The resultant toner image on the photosensitive drum 1 is transferred onto a surface of a recording medium P.

The recording media P stored in a sheet feed tray 101, are fed one by one by a feeding roller 102 to be supplied to a transfer nip portion T between the photosensitive drum 1 and a transfer roller 5 through conveyance rollers 103 and the like. In this process, a leading edge of the recording medium P is detected by a top sensor 104. The timing at which the leading edge of the recording medium P reaches the transfer nip portion T is detected based on the positions of the top sensor 104 and the transfer nip portion T, and the conveyance speed of the recording medium P. The toner image on the photosensitive drum 1 is transferred onto the recording medium P, fed and conveyed at the predetermined timing as described above while a transfer bias is applied to the transfer roller (transfer unit) 5.

The recording medium P on which the toner image has been transferred is conveyed to a fixing apparatus 6. In the fixing apparatus 6, the recording medium P is heated and pressed while being conveyed through a fixing nip portion between a film unit 10 and a pressing roller 20, so that the toner image is fixed on the recording medium P. Then, the recording medium P is discharged onto an output tray 107 disposed on an upper surface of a printer main body 100, by discharge rollers 106. In this process, with a sheet discharge sensor 105, timing at which the leading edge and the trailing edge of the recording medium P pass is detected, and whether jamming and the like have occurred is monitored.

After the toner image is transferred, toner that has not been transferred onto the recording medium P and remains on the surface of the photosensitive drum 1 is removed by a cleaning blade 71 of a cleaning device 7. Thus, the photosensitive drum 1 becomes ready to be used for the next image forming.

Image forming can be successively performed by repeating the operation described above.

A throughput of the printer according to the present exemplary embodiment is 40 sheets per minute (letter (LTR) size longitudinal feed: process speed of approximately 222 mm per second).

<Fixing Apparatus>

Figure 2A:
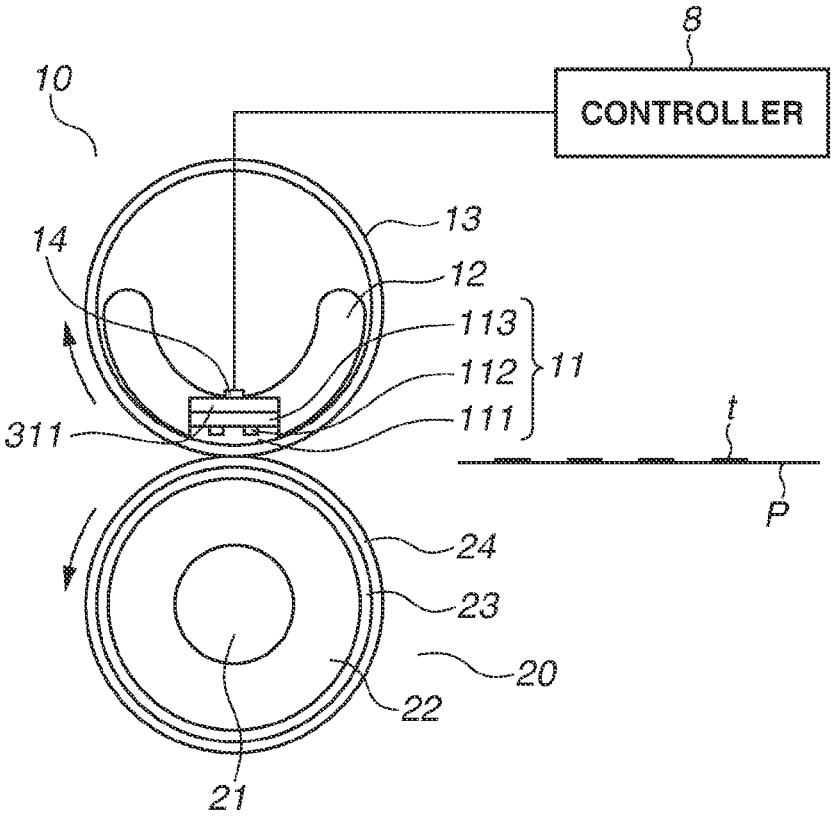
FIG. 2A is a cross-sectional view of a fixing apparatus according to the first exemplary embodiment.
Figure 2B:
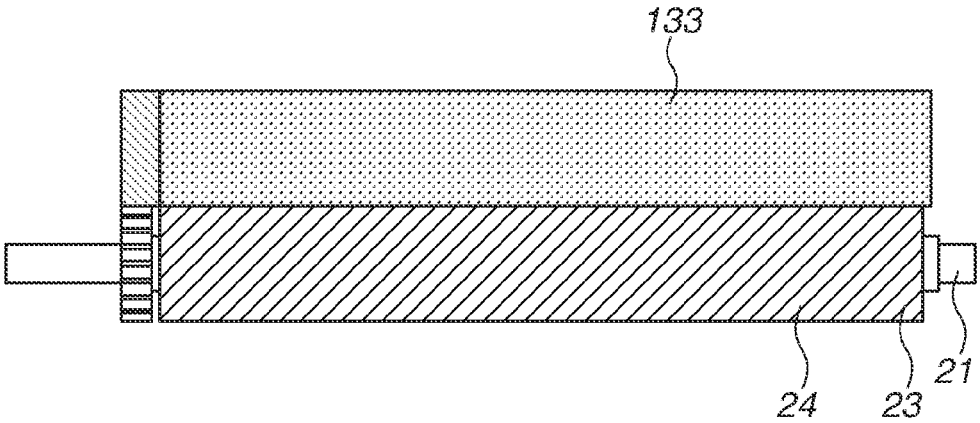
FIG. 2B is a diagram illustrating a film and a pressing roller according to the first exemplary embodiment as viewed in a conveyance direction of a recording medium.

FIG. 2A is a cross-sectional view illustrating a schematic configuration of the fixing apparatus 6 according to the present exemplary embodiment. The fixing apparatus includes a film 13 in a tubular shape, a heater 11 disposed to contact an inner surface of the film 13, a heat conducting member 311 in contact with the heater 11, a heater holder 12 that holds the heater 11, and the pressing roller 20 that forms the nip portion together with the heater 11 across the film 13. The recording medium P on which the tone image has been formed is heated while being conveyed through the nip portion, so that the toner image is fixed on the recording medium P.

Figure 3:
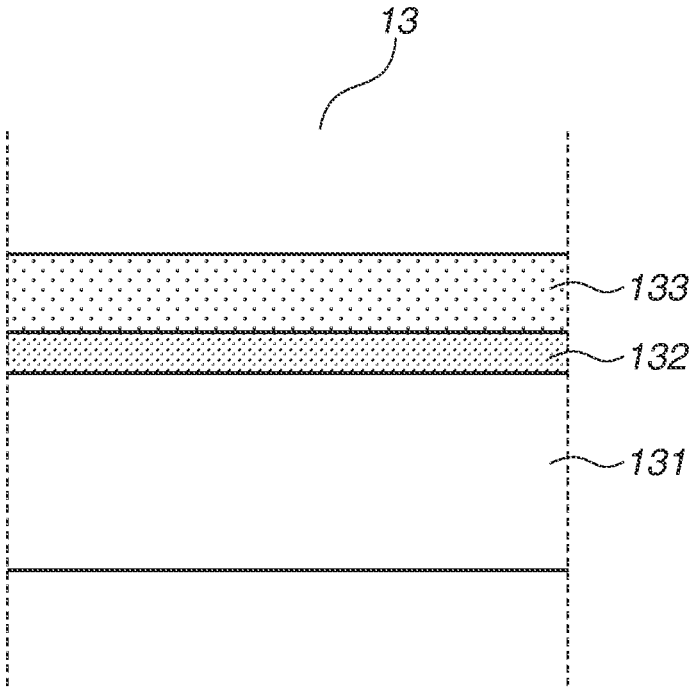
FIG. 3 is a diagram illustrating a layer configuration of the film according to the first exemplary embodiment.

A layer configuration of the film 13 is described with reference to FIG. 3 that is a cross-sectional view of the film 13. The film 13 includes a base layer 131, a primer layer 132 formed on an outer side of the base layer 131, and a release layer 133 formed on an outer side of the primer layer 132. The base layer 131 is formed of metal such as stainless steel (SUS) or resin such as polyimide (PI) and polyether ether ketone (PEEK). The release layer 133 is formed by coating on the primer layer 132 or covering the primer layer 132 with a tube. The thickness of the film 13 is preferably equal to or smaller than 100 μm so that the device can be warmed up in a short period of time, and equal to or larger than 20 μm so that satisfactory endurance can be ensured. Accordingly, the thickness of the film 13 is preferably equal to or larger than 20 μm and equal to or smaller than 100 μm.

The heater 11 is a plate shaped member, and includes a substrate 111, heat generating resistor layers (heat generating resistors) 112 formed on the substrate 111, and a protecting layer 113. The substrate 111 is formed of alumina ($Al_2O_3$) with a thermal conductivity of approximately 24.0 W/m·K, or aluminum nitride (AlN) with a thermal conductivity of approximately 150.0 W/m·K. The heat generating resistor layers 112 are formed by screen-printing silver palladium and the like on the substrate 111. The protecting layer 113 is formed by providing a thin coating of glass on the outer side of the heat generating resistor layers 112. In the present exemplary embodiment, alumina is used for the substrate 111. The substrate 111 has a size of 6.00 mm (width)×260.0 mm (length)×1.00 mm (thickness). Two pieces of the heat generating resistor layers 112, each having a length of 220.0 mm and a width of 0.90 mm, are provided. The film 13 is heated by bringing a surface of the heater 11, on which the heat generating resistor layers 112 are formed or its opposite surface, into contact with the inner surface of the film 13.

A thermistor 14 serving as a temperature detection unit, detects a temperature of a surface of the heater 11 disposed opposite to a surface contacting the film 13 via a heat conducting member 311 described below. A controller 8 controls power supplied to the heater 11 so that a temperature detected by the thermistor 14 becomes a target temperature. A resistance value of the heater 11 according to the present exemplary embodiment is 20 Ω (720 W when 120 V is input).

The heater holder (supporter) 12 supports and holds the heater 11 through the heat conducting member 311. The heater holder 12 has a groove in which the heater 11 and heat conducting member 311 are accommodated. The heater holder 12 is formed of liquid crystal polymer, phenol resin, polyphenylenesulfide (PPS), PEEK, and the like. The film 13 is rotatably and loosely fit onto an outer side of the heater holder 12. The film 13 rotates while sliding on the heater 11 and the heater holder 12, and thus heat resistant grease is applied between these components.

The pressing roller 20 serving as a backup member includes a metal core 21, an elastic layer 22 on an outer side of the metal core 21, a release layer 24 on an outer side of the elastic layer 22, and an adhesive layer 23 between the elastic layer 22 and the release layer 24. The metal core 22 is formed of an aluminum alloy, iron (Fe), or the like. The elastic layer 22 is formed of foamed heat resistant rubber such as insulative silicone rubber or fluororubber. The release layer 24 is formed by covering the adhesive layer 23 with a tube made of perfluoroalkoxy (PFA), polytetrafluoroethylene (PTFE), fluorinated ethylene propylene (FEP) or the like in which a conducting agent such as carbon is dispersed, or by providing a coating on the adhesive layer 23. The pressing roller 20 according to the present exemplary embodiment has a roller outer diameter of 20 mm and a roller hardness of 48° (Asker-C, 600 g weighted).

In the present exemplary embodiment, the film 13, the heater 11, and the heater holder 12 are formed as a single unit, that is, the film unit 10. The pressing roller 20 is pressed against the film unit 10 by pressing mechanisms (not illustrated) disposed on both end portions in the longitudinal direction, so that the nip portion is formed.

The pressing roller 20 rotates when driving force is transmitted to a driven member (not illustrated) disposed on an end portion of the metal core 21 from a driving source. The film 13 is driven to rotate in a direction indicated by an arrow illustrated in FIG. 2A upon receiving friction force from the pressing roller 20 at the nip portion.

Figure 4A:
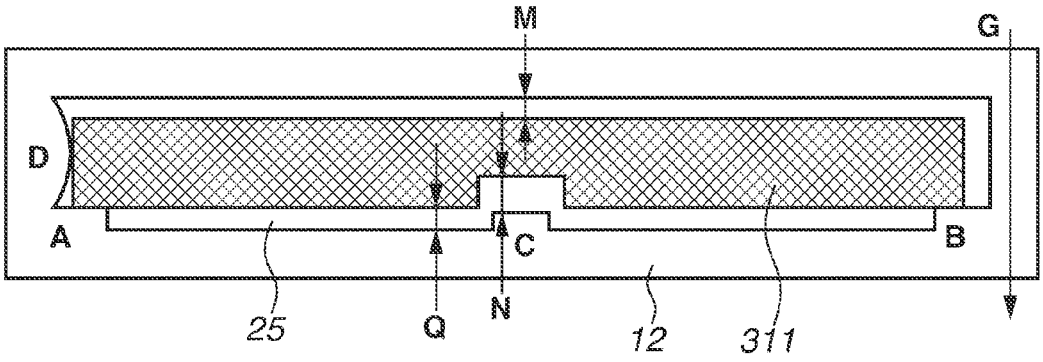
FIG. 4A is a front view illustrating a state where an aluminum plate is mounted to a heater holder according to the first exemplary embodiment (static state)
Figure 6A:
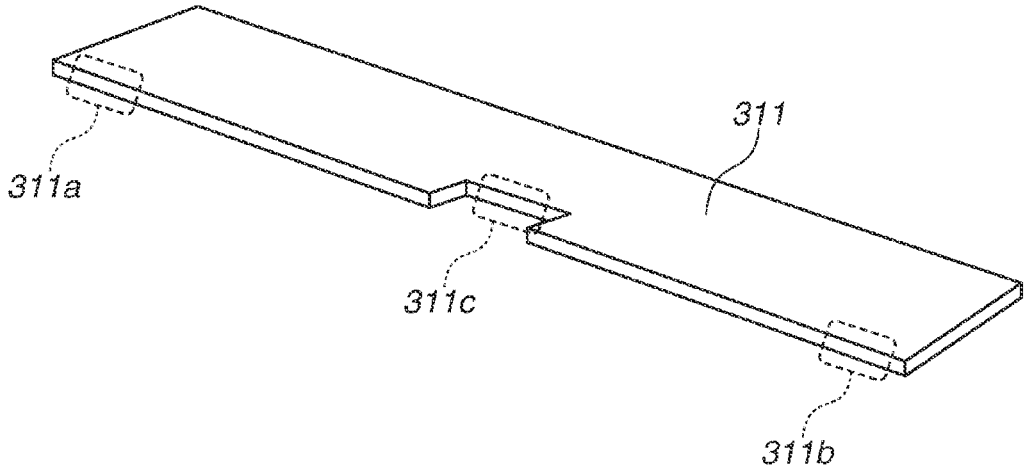
FIG. 6A is a perspective view of the aluminum plate according to the first exemplary embodiment.

FIG. 4A is a front view illustrating a state where the heat conducting member 311 according to the present exemplary embodiment is mounted to the heater holder 12. The heat conducting member 311 is an aluminum plate formed of aluminum alloy 1050 which shows a thermal conductivity of 230 W/m. The heat conducting member 311 is referred to as an aluminum plate 311 in the description of the present exemplary embodiment below. FIG. 6A is a perspective view of the aluminum plate 311 according to the present exemplary embodiment. The aluminum plate 311 has a size of 210 mm (length)×6.0 mm (width)×0.30 mm (thickness). The aluminum plate 311 has a center portion in the longitudinal direction, which is provided with a notch having a smaller width than other portions in the transverse direction. The notch is described below.

The width of the aluminum plate 311 is described. The aluminum plate 311 having a larger width can achieve a larger effect in preventing the temperature rise of a sheet non-passing portion, but is more likely to thermally expand. The aluminum plate 311 with a larger width has a larger heat capacity, which is disadvantageous in terms of reduction in the warmup time of the fixing apparatus 6. Therefore, to achieve the best balance between the advantage and the disadvantage described above, the aluminum plate 311 according to the present exemplary embodiment is set to have substantially the same width as the heater 11. The aluminum plate 311 with a larger length in the longitudinal direction achieves a larger effect in preventing the temperature rise of the sheet non-passing portion, but may lead to a lower fixing performance at the end portion of the recording medium P. Therefore, in the present exemplary embodiment, the length of the aluminum plate 311 in the longitudinal direction is set to 210 mm to achieve the best balance between the temperature rise of the sheet non-passing portion and the fixing performance at the end portion. The aluminum plate 311 having a larger thickness provides a larger effect in preventing the temperature rise of the sheet non-passing portion, but has a larger heat capacity, which is disadvantage in terms of reduction in the warmup time of the fixing apparatus 6. Thus, in the present exemplary embodiment, the thickness of the aluminum plate 311 is set to 0.30 mm to achieve the best balance between the advantage and the disadvantage described above.

Figure 6B:
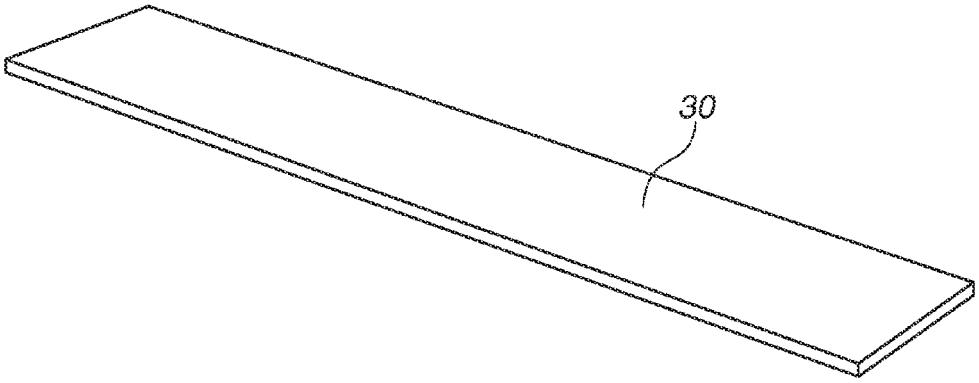
FIG. 6B is a perspective view of the aluminum plate according to the comparative example.

Next, a problem to be addressed by the present exemplary embodiment is described with reference to a configuration according to a comparative example. The comparative example is different from the present exemplary embodiment only in the shape of the heat conducting member, and the rest of the configuration is the same. A heat conducting member 30 according to the comparative example is formed of the aluminum alloy 1050 as in the present exemplary embodiment. The heat conducting member 30 according to the comparative example is hereinafter referred to as an aluminum plate 30. FIG. 6B is a perspective view of the aluminum plate 30 according to the comparative example. The aluminum plate 30 is a rectangular parallelepiped having a size of 210 mm (length)×6.0 mm (width)×0.30 mm (thickness). The aluminum plate 30 does not have the notch provided in the aluminum plate 311 according to the present exemplary embodiment.

Figure 5A:
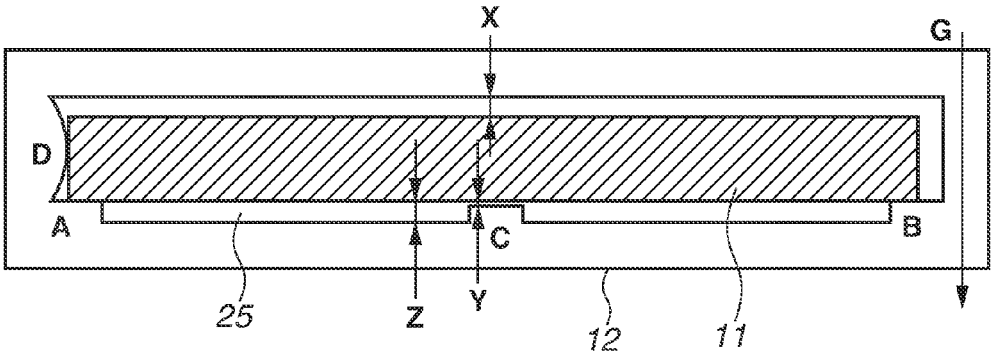
FIG. 5A is a front view illustrating a state where an aluminum plate and a heater are mounted to a heater holder according to a comparative example (static state)
Figure 5B:
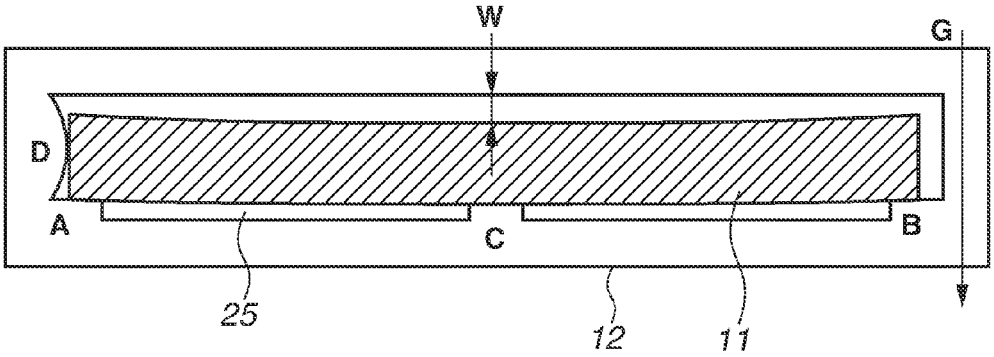
FIG. 5B is a front view illustrating a state where the aluminum plate and the heater are mounted to the heater holder according to the comparative example (dynamic state).

FIGS. 5A and 5B are each a front view illustrating a state where the heater 11 and the heat conducting member 30 are mounted to the heater holder 12, and represent the comparative example of the present exemplary embodiment. FIG. 5A illustrates a static state where the film 13 is not rotating. FIG.

5B illustrates a dynamic state where the film 13 is rotating. In FIGS. 5A and 5B, the heat conducting member 30 is hidden behind the heater 11.

The heater holder 12 according to the comparative example is similar to the present exemplary embodiment, and has a groove 25 formed in the longitudinal direction along the heater 11. A protrusion D (fourth protrusion) that serves as a positioning portion for the heater 11 in the longitudinal direction is formed on one end surface of the trench portion 25 in the longitudinal direction. A surface of the groove 25 facing a surface of the heater 11 on a downstream side in the conveyance direction of the recording medium P includes a protrusion A (first protrusion), a protrusion B (second protrusion) with a gap between each other in the longitudinal direction. Further, the surface of the groove 25 includes a protrusion C (third protrusion) disposed between the protrusion A and the protrusion B. The protrusion C has a smaller protruding amount than the protrusions A and B by a gap Y. In the present exemplary embodiment, the protrusions A and B are disposed at both end portions in the longitudinal direction and serve as positioning portions for the heater 11 in the transverse direction. The protrusion C serves as a warpage preventing portion for the heater 11 deformed in a warped manner to have a center portion shifted in the conveyance direction of the recording medium due to the frictional force from the film 13 in the dynamic state. The protrusion C can prevent widening of a gap X between a surface of the trench portion 25 on an upstream side in the conveyance direction of the recording medium and a surface of the heater 11 on the upstream side even when the center portion of the heater 11 warps in the conveyance direction of the recording medium in the dynamic state. The pressing roller 20 is pressed against the film unit 10 in which the heater 11 is in contact with the positioning portions A, B, and C of the heater holder 12. In the present exemplary embodiment, the widths of the gaps X, Y, and Z in the static state are respectively 0.30 mm, 0.05 mm, and 0.30 mm.

Figure 7A:
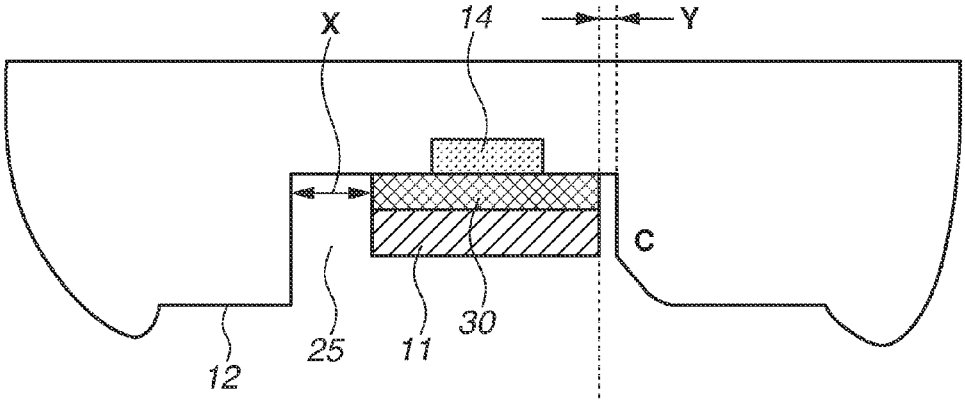
FIG. 7A is a cross-sectional side view illustrating a state where the aluminum plate and the heater are mounted to the heater holder according to the comparative example (static state)
Figure 7B:
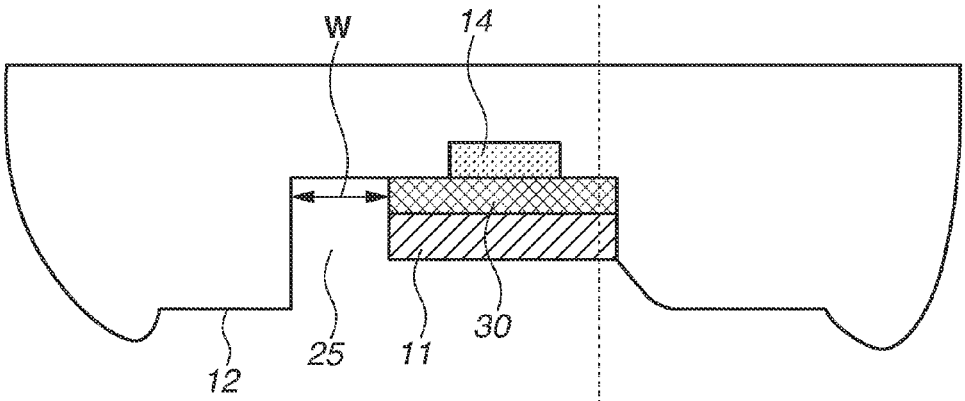
FIG. 7B is a cross-sectional side view illustrating a state where the aluminum plate and the heater are mounted to the heater holder according to the comparative example (dynamic state)
Figure 7C:
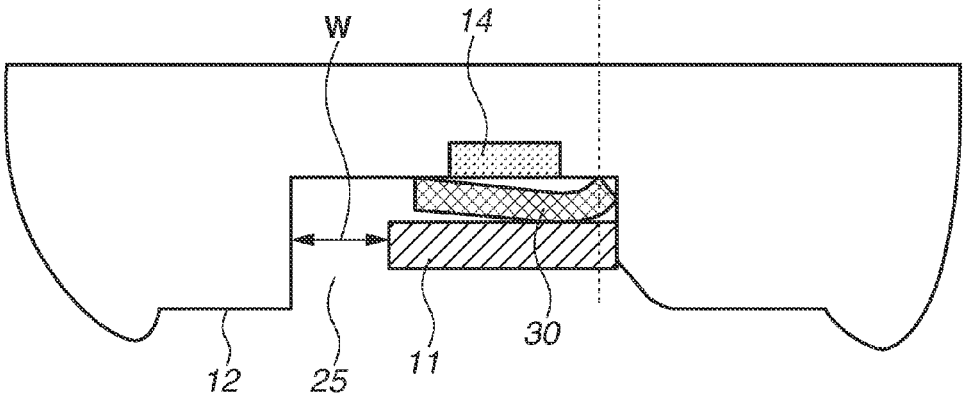
FIG. 7C is a cross-sectional side view illustrating a state where the aluminum plate and the heater are mounted to the heater holder according to the comparative example (state after temperature rises in the dynamic state).

FIGS. 7A and 7B are cross-sectional side views of the center portion in the longitudinal direction respectively illustrating the static state and the dynamic state of the film unit 10 formed by assembling the heater holder 12, the heater 11, the heat conducting member 30, and the thermistor 14. FIG. 7C is a cross-sectional side view illustrating a dynamic state where the temperature has risen from the state illustrated in FIG. 7B.

In the dynamic state, as illustrated in FIG. 5B, while the center portion of the heater 11 warps in the conveyance direction of the recording medium, the center portion does not warp after the center portion of the end surface of the heater 11 comes into contact with the protrusion C. Thus, the width of the gap W that is 0.35 mm in this state does not increase any further, so that foreign substances can be prevented from entering the gap W.

However, as illustrated in FIG. 7B, in the dynamic state, the center portion of the aluminum plate 30 in the longitudinal direction which is sandwiched between the heater 11 and the heater holder 12, warps in the conveyance direction of the recording medium, so that the center portion is brought into contact with the protrusion C in the groove 25, as in the case of the heater 11. When the aluminum plate 30 is further heated in this state and further thermally expanded, the aluminum plate 30 may deform to lift from the heater 11 due to thermal stress received from the protrusion C, as illustrated in FIG. 7C. Presumably, this is because there is no space for the thermal expansion of the aluminum plate 30 when it is in contact with the protrusion C. As a result, a problem arises that an area where the aluminum plate 30 is in contact with the heater 11 becomes smaller, and the effect in preventing the temperature rise of the sheet non-passing portion is reduced. Furthermore, the deformation may further cause the problem that the thermistor 14 cannot accurately detect the temperature of the heater 11.

Figure 4B:
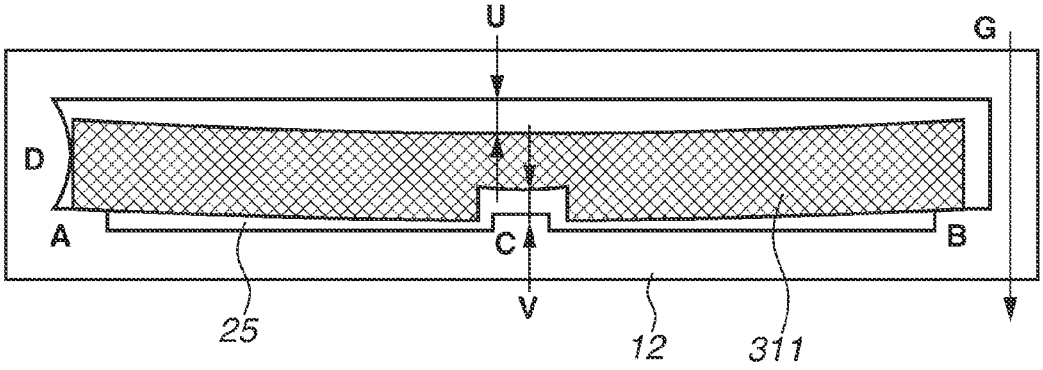
FIG. 4B is a front view illustrating a state where the aluminum plate is mounted to the heater holder according to the first exemplary embodiment (dynamic state).

Next a configuration of the fixing apparatus 6 according to the present exemplary embodiment is described with reference to FIGS. 4A, 4B, and 6B. The present exemplary embodiment is different from the comparative example only in the configuration of the heat conducting member, and thus a description on the other common configuration will be omitted. The surface of the aluminum plate 311 on the downstream side in the conveyance direction of the recording medium P has a portion 311*c* that faces the protrusion C and is offset in a direction apart from the protrusion C compared with portions 311*a* and 311*b* that respectively face the protrusions A and B. In the present exemplary embodiment, the aluminum plate 311 has a notch serving as the offset portion 311*c*. According to the present exemplary embodiment, the offset area in the aluminum plate 311 is the notch. Accordingly, a width of the aluminum plate 311 in the conveyance direction of the recording medium P is narrower at a portion of the aluminum plate 311, overlapping with the protrusion C, when the heater holder 12 and the aluminum plate 311 are viewed in a conveyance direction of the recoding medium, than at a portion of the aluminum plate not overlapping with the protrusion C. Thus, even when the aluminum plate 311 warps in the conveyance direction of the recording medium due to the rotation of the film 13, a clearance of 0.15 mm or larger can be ensured between the protrusion C and the portion 311*c* of the aluminum plate 311 facing the protrusion C. Therefore, the aluminum plate 311 that has thermally expanded is less likely to receive the thermal stress, and thus can be prevented from deforming due to the thermal stress. As a result, decrease of the contact area between the aluminum plate 311 and the heater 11 can be prevented, so that the effect in preventing the temperature rise of the sheet non-passing portion in the aluminum plate 311, can be maintained. Furthermore, accuracy degradation of the temperature of the heater 11 detected by the thermistor 14 can be prevented. Furthermore, the warpage amount of the heater 11 can be prevented from increasing by the protrusion C as in the comparative example, and thus foreign substances can be prevented from entering the gap between the heater 11 and the groove 25.

As described above, the present exemplary embodiment can provide the following effect in the fixing apparatus including a holding member in which the heat conducting member and the heater are accommodated in the groove. That is, prevention of the entrance of foreign substances into the gap between the heater and the groove, and the maintaining of the effect in preventing the temperature rise of the sheet non-passing portion can be both achieved.

The heat conducting member, which is the aluminum plate in the present exemplary embodiment, may be any material such as a metal plate or a graphite sheet for example, as long as a thermal conductivity is higher than the substrate of the heater.

While the protruding amount of the protrusion C is smaller than the protrusions A and B in the present exemplary embodiment, the protruding amount may be the same as the protrusions A and B.

While the protrusions A and B are disposed in both end portions of the heater in the longitudinal direction in the present exemplary embodiment, the protrusions A and B may be disposed on the inner side of the end portions.

In the present exemplary embodiment, the width of the notch of the aluminum plate in the longitudinal direction is slightly larger than the width of the protrusion C, but may be even larger. The length, the width, and the thickness of the aluminum plate are not limited to the sizes in the present exemplary embodiment.

A configuration of a fixing apparatus according to a second exemplary embodiment is different from the first exemplary embodiment only in the heater holder and the heat conducting member, and thus a description on the other common portions will be omitted.

The heat conducting member 30 according to the present exemplary embodiment is the same as that in the comparative example of the first exemplary embodiment as illustrated in FIG. 6B, and is the aluminum plate 30 having the rectangular parallelepiped shape.

Figure 8A:
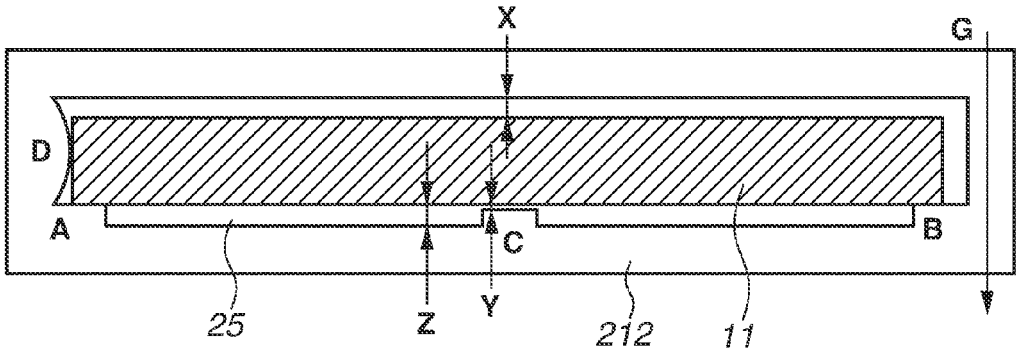
FIG. 8A is a front view illustrating a state where an aluminum plate and a heater are mounted to a heater holder according to a second exemplary embodiment (static state)
Figure 8B:
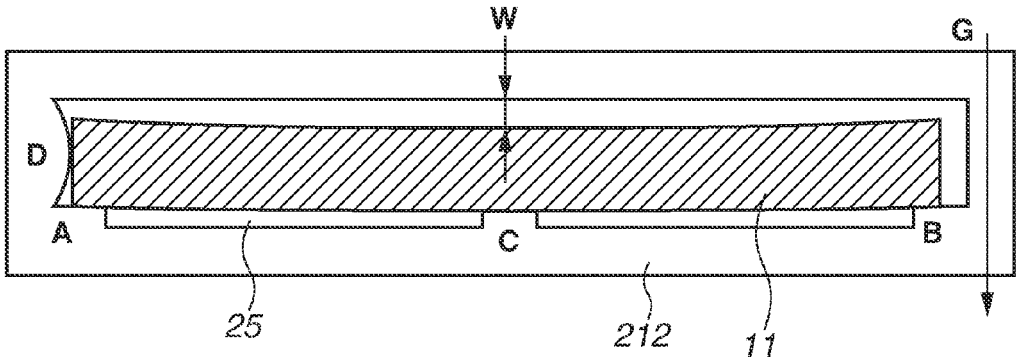
FIG. 8B is a front view illustrating a state where the aluminum plate and the heater are mounted to the heater holder according to the second exemplary embodiment (dynamic state).
Figure 9A:
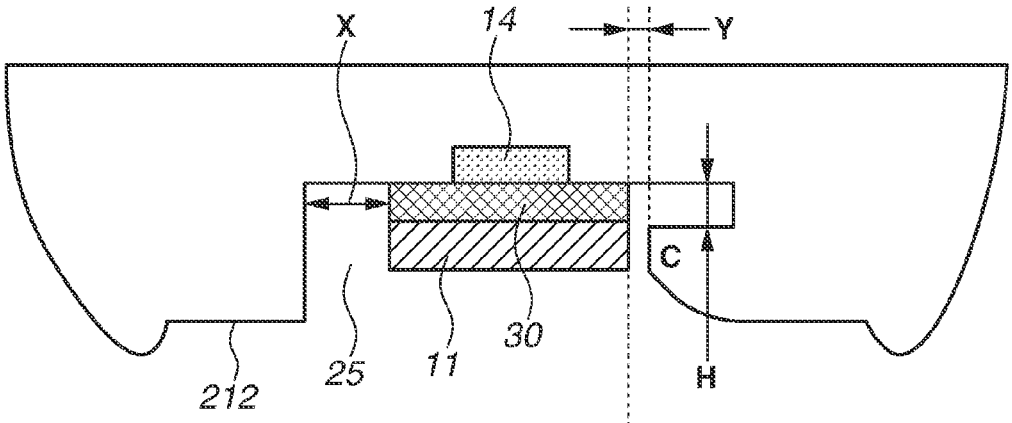
FIG. 9A is a cross-sectional side view illustrating a state where the aluminum plate and the heater are mounted to the heater holder according to the second exemplary embodiment (static state)
Figure 9B:
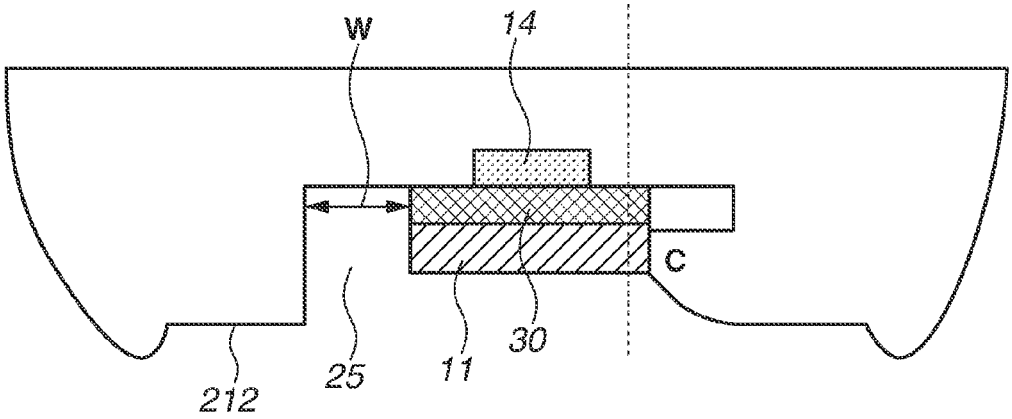
FIG. 9B is a cross-sectional side view illustrating a state where the aluminum plate and the heater are mounted to the heater holder according to the second exemplary embodiment (dynamic state).

A heater holder 212 according to the present exemplary embodiment is described. FIGS. 8A and 8B are a front view illustrating a state where the heater 11 and the heat conducting member 30 are mounted to the heater holder 212 according to the present exemplary embodiment. FIGS. 9A and 9B are a cross-sectional side view of the center portion in the longitudinal direction, illustrating a state where the heater 11 and the heat conducting member 30 are mounted to the heater holder 212 according to the present exemplary embodiment. FIGS. 8A and 9A illustrate a static state where the film 13 is not rotating. FIGS. 8B and 9B illustrate a dynamic state where the film 13 is rotating. As illustrated in FIGS. 8A and 8B, the heater holder 212 according to the present exemplary embodiment has the groove 25 formed in the longitudinal direction along the heater 11. One end surface of the trench portion 25 in the longitudinal direction includes the protrusion D (fourth protrusion) serving as the positioning portion for the heater 11 in the longitudinal direction. The surface of the trench portion 25 facing the surface of the heater 11 on the downstream side in the conveyance direction of the recording medium, includes the protrusion A (first protrusion) and the protrusion B (second protrusion) that are disposed being spaced apart from each other in the longitudinal direction, and further includes the protrusion C (third protrusion) disposed between the protrusions A and B. The protruding amount of the protrusion C is smaller than the protrusions A and B by the gap Y. The protrusions A and B according to the present invention are disposed at both end portions in the longitudinal direction, and function as the positioning portions for the heater 11 in the transverse direction. The protrusion C serves as the warpage prevention portion for the heater 11 when the center portion of the heater 11 is warped and deformed in the conveyance direction of the recording medium P due to the frictional force received from the film 13 in the dynamic state. Thus, the protrusion C can prevent the gap X between the surface of the groove 25 on the upstream side in the conveyance direction of the recording medium and the surface of the heater 11 on the upstream side, from widening when the heater 11 is warped in the conveyance direction of the recording medium P in the dynamic state. The pressing roller 20 is pressed against the film unit 10 in which the heater 11 is in contact with the positioning portions A, B, and C of the heater holder 212. In the present exemplary embodiment, the widths of the gaps X, Y, and Z in the static state are respectively 0.30 mm, 0.05 mm, and 0.30 mm.

A feature of the present exemplary embodiment is a configuration in which the protrusion C is formed only at a portion facing the end surface of the heater 11 on the downstream side in the conveyance direction of the recording medium P, and is not formed at the portion facing the end surface of the aluminum plate 30 as illustrated in FIGS. 9A and 9B. In the present exemplary embodiment, a height H of the portion that faces the end surface of the aluminum plate 30 where no protrusion C is formed is set to 0.35 mm. Thus, when the fixing apparatus is in the dynamic state, the heater 11 warps in the conveyance direction of the recording medium P to be brought into contact with the protrusion C, but the aluminum plate 30 that warps together with the heater 11 does not come into contact with the heater holder 212. As a result, the aluminum plate 30 can thermally expand in the conveyance direction of the recording medium P. Thus, the thermal stress is less likely to be produced, so that the aluminum plate 30 can be prevented from deforming in a direction of lifting from the heater 11. Furthermore, the aluminum plate 30 according to the second exemplary embodiment does not need to have the notch in the portion facing the protrusion C of the heater holder 212 as in the first exemplary embodiment, and thus can provide a higher effect in preventing the temperature rise of the sheet non-passing portion than in the first exemplary embodiment.

In the configuration according to the second exemplary embodiment, the center portion of the heater 11 in the longitudinal direction warps in the conveyance direction of the recording medium P in the dynamic state. However, the center portion of the end surface of the heater 11 warps only up to where the center portion comes into contact with the protrusion C, and further warpage is prevented as illustrated in FIG. 8B. Accordingly, the gap W between the surface of the groove 25 on the upstream side in the conveyance direction of the recording medium P and the surface of the heater 11 on the upstream side, is 0.35 mm, and is not widened any further, so that foreign substances can be prevented from entering the gap W.

As described above, the present exemplary embodiment can provide the following effect in the fixing apparatus including the holding member in which the heat conducting member and the heater are accommodated in the groove. That is, both the prevention of the entrance of foreign substances into the gap between the groove and the heater and the maintaining of the effect in preventing the temperature rise of the sheet non-passing portion can be achieved.

In the present exemplary embodiment, the protrusion C of the heater holder 212 is only formed in the portion facing the end surface of the heater 11 on the downstream side in the conveyance direction of the recording medium P. Alternatively, a configuration may be employed in which a portion of the protrusion C of the heater holder 212 facing the end surface of the aluminum plate 30 on the downstream side in the conveyance direction of the recording medium P is offset (recessed) in the conveyance direction of the recording medium P compared with a portion facing the end surface of the heater 11.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-032065, filed Feb. 20, 2015, which is hereby incorporated by reference herein in its entirety.

What is claimed is:

1. A fixing apparatus for fixing a toner image on the recording medium while conveying and heating the recording medium bearing the toner image at a nip portion, the fixing apparatus comprising:

a tubular film;

a plate-like heater contacting an inner surface of the film;

a heat conducting member contacting a surface of the heater opposite to a surface of the heater contacting the film; and a supporter configured to support the heater via the heat conducting member, the supporter including a groove in which the heater and the heat conducting member are accommodated, wherein a surface of the groove facing an end surface of the heater on a downstream side in a conveyance direction of the recording medium includes a first protrusion, a second protrusion, and a third protrusion that are disposed with gaps between each other in a direction orthogonal to the conveyance direction of the recording medium, the third protrusion being disposed between the first protrusion and the second protrusion, the third protrusion having a smaller protruding amount in a direction opposite to the conveyance direction than protruding amounts of the first protrusion and the second protrusion, and wherein a portion of the heat conducting member facing the third protrusion is recessed more than portions of the heat conducting member facing the first protrusion and the second protrusion.

2. The fixing apparatus according to claim 1, wherein the heater includes a substrate and a heat generating resistor formed on the substrate, and wherein a thermal conductivity of the heat conducting member is higher than that of the substrate.

3. The fixing apparatus according to claim 1, wherein the heat conducting member has a smaller width in the conveyance direction at a portion of the heat conducting member, overlapping with the third protrusion when the supporter and the heat conducting member are viewed in the conveyance direction, than at a portion of the heat conducting member not overlapping with the third protrusion.

4. The fixing apparatus according to claim 1, wherein the heat conducting member is a plate formed of aluminum.

5. A fixing apparatus for fixing a toner image on the recording medium while conveying and heating the recording medium bearing the toner image at a nip portion, the fixing apparatus comprising:

a tubular film;

a plate-like heater contacting an inner surface of the film;

a heat conducting member contacting a surface of the heater opposite to a surface contacting the film; and a supporter configured to support the heater via the heat conducting member, the supporter including a groove in which the heater and the heat conducting member are accommodated, wherein a surface of the groove facing an end surface of the heater on a downstream side in a conveyance direction of the recording medium includes a first protrusion, a second protrusion, and a third protrusion that are disposed with gaps between each other in a direction orthogonal to the conveyance direction, the third protrusion being disposed between the first protrusion and the second protrusion, the third protrusion having a smaller protruding amount in a direction opposite to the conveyance direction than protruding amounts of the first protrusion and the second protrusion, and wherein the third protrusion is formed only in the surface of the groove facing the end surface of the heater on the downstream side, or a portion of the third protrusion facing an end surface of the heat conducting member on the downstream side in the conveyance direction is recessed more than a portion of the third protrusion facing the end surface of the heater on the downstream side.

6. The fixing apparatus according to claim 5, wherein the heater includes a substrate and a heat generating resistor formed on the substrate, and wherein a thermal conductivity of the heat conducting member is higher than that of the substrate.

7. The fixing apparatus according to claim 5, wherein the heat conducting member is a plate formed of aluminum.

* * * * *